US007571583B2

(12) United States Patent
Winfield

(10) Patent No.: US 7,571,583 B2
(45) Date of Patent: Aug. 11, 2009

(54) SEALING SYSTEM FOR AN ENERGY EFFICIENT WINDOW

(75) Inventor: Alan H. Winfield, Edmonton (CA)

(73) Assignee: Visionwall Corporation, Edmonton, Alberta (CA)

( * ) Notice: Subject to any disclaimer, the term of this patent is extended or adjusted under 35 U.S.C. 154(b) by 84 days.

(21) Appl. No.: 10/537,399

(22) PCT Filed: Dec. 5, 2002

(86) PCT No.: PCT/CA02/01889

§ 371 (c)(1),
(2), (4) Date: Mar. 15, 2006

(87) PCT Pub. No.: WO2004/051045

PCT Pub. Date: Jun. 17, 2004

(65) Prior Publication Data

US 2006/0260228 A1 Nov. 23, 2006

(51) Int. Cl.
*E06B 3/663* (2006.01)

(52) U.S. Cl. ..... 52/786.13; 428/34

(58) Field of Classification Search ..... 52/786.1, 52/786.13, 309.14, 171.3, 204.5, 204.591, 52/204.593, 204.6, 204.62, 204.595, 172; 428/34

See application file for complete search history.

(56) References Cited

U.S. PATENT DOCUMENTS

| | | | | |
|---|---|---|---|---|
| 4,658,553 | A * | 4/1987 | Shinagawa | 52/172 |
| 5,237,787 | A | 8/1993 | Grether et al. | |
| 5,260,112 | A | 11/1993 | Grether et al. | |
| 5,962,090 | A | 10/1999 | Trautz | |
| 6,289,641 | B1 * | 9/2001 | McCandless | 52/172 |
| 6,339,909 | B1 | 1/2002 | Brunnhofer et al. | |

FOREIGN PATENT DOCUMENTS

| | | |
|---|---|---|
| DE | 3302659 | 8/1984 |
| JP | 62-105287 | 7/1987 |
| JP | 7-26846 | 1/1995 |
| WO | 9915753 | 4/1999 |

* cited by examiner

*Primary Examiner*—Richard E Chilcot, Jr.
*Assistant Examiner*—Bryan Eppes
(74) *Attorney, Agent, or Firm*—Bennett Jones LLP

(57) ABSTRACT

A heat insulation window includes a pair of outer panes (14, 16) defining an interior air space (12) and held apart by a spacing member which as opposed and parallel first and second outer surfaces. A third outer surface extends between the first (21) and second (23) outer surfaces. The spacing member defines a first sealing groove (32) at the junction between the first (21) and third (19) outer surfaces and a second sealing groove (32) at the junction between the second (23) and third (19) outer surfaces. The sealing grooves (32) are filled with a gas-tight seal element. A metal band (34) overlays the third (19) outer surface and has edge flanges (34A, 34B) which fit into the first and second sealing grooves (32), isolating the third (19) outer surface from the seal element.

5 Claims, 2 Drawing Sheets

SEALING SYSTEM FOR AN ENERGY EFFICIENT WINDOW

FIELD OF THE INVENTION

The present invention relates to an energy efficient window and, in particular, to a sealing system for energy efficient windows.

BACKGROUND OF THE INVENTION

Windows or glass areas are a significant weakness in heat insulation schemes for buildings in hot or cold climates. A basic insulating window that is well-known is constructed from two panes of glass within a rigid frame. The air space between the panes provides heat insulation. It is also known to evacuate the air space or to fill the air space with a gas of lower thermal conductivity than air such as argon. One further method of enhancing the insulating value of such a window is to increase the air space and provide transparent partitions between the outer glass panes to reduce convective heat transfer within the unit.

Other technologies include providing selectively reflecting or low-emissivity coatings to reduce radiant heat transfer through the window. As well, there have been significant improvements in the window frame, both in the union of the glass panes and the design and material of the frame. The layers of glazing in an insulating unit must be held apart at the appropriate distance by spacers. Because of its excellent structural properties, window manufacturers have used aluminum spacers. Unfortunately, aluminum is an excellent conductor of heat and the aluminum spacer used in most standard edge systems represented a significant thermal "short circuit" at the edge of the insulating glass unit, which reduces the benefits of improved glazings. In addition to the increased heat loss, the colder edge is more prone to condensation.

A window comprising a compound glass element with an edge binding member is described in U.S. Pat. No. 5,260,112 (corresponding to Canadian Patent No. 2,029,148). The edge binding member holds two glass planes apart in a parallel condition and seals the space between the glass panes from the exterior. A suitable edge binding member must provide a stable mechanical bond between the glass panes to ensure the physical integrity of the window unit. The edge binding member must also be vapour tight to prevent the penetration of vapour between the glass panes and consequent condensation that will occur within the window unit. Lastly, the edge binding member must not provide a thermal bridge between the glass panes, or should at least minimize heat transfer from one pane to the other. With the edge binding member of this patent, a metal foil band wraps around a spacer and substantially bridges the glass panes. The spacer is glued to the glass panes with an acrylate adhesive. At the outer edges of the metal band, close to the glass panes, the spacer is bevelled, creating a triangular void space. The void space is filled with a highly vapour resistant hot-melt butyl adhesive.

While this system does provide a solution to the vapour block problem, a significant additional problem arises. The spacer is typically made from a thermoplastic material with a significantly higher thermal coefficient of expansion that the steel band. The butyl adhesive tends to creep into the space between the plastic spacer and the metal band, thereby adhering the two together. When subject to thermal expansion or contraction, the different rates of expansion between the plastic and the metal may cause the spacer to fail, or it may disrupt the integrity of the butyl seal.

Therefore, there is a need in the art for an energy efficient window unit which includes a spacer and seal system which mitigates the difficulties posed by the prior art.

SUMMARY OF THE INVENTION

The present invention is directed at energy efficient windows having an edge spacer and sealing system. Therefore, in one aspect, the invention comprises a heat insulation window comprising:

(a) a pair of outer panes defining an air space therebetween;

(b) a spacing member disposed between the outer panes which maintain the panes in a spaced-apart relationship, the spacing member having a first and second outer surfaces which are opposed and parallel, and a third outer surface extending between the first and second outer surfaces;

(c) wherein the spacing member defines a first sealing groove at the junction between the first and third outer surfaces and a second sealing groove at the junction between the second and third outer surfaces;

(d) a gas-tight seal element contained within the first and second sealing grooves; and (e) a metal band parallel to and overlaying the third outer surface, wherein the band comprises edge flanges which fit into the first and second sealing grooves, thereby isolating the third outer surface from the seal element.

In a preferred embodiment, the window further comprises an interface layer between the third outer surface and the metal band. Further, the seal element comprises hot-melt butyl adhesive and the metal band comprises a stainless steel foil. Also, the spacing member comprises a central spacer and opposing lateral members, wherein the central spacer separates the opposing lateral members and at least one lateral member comprises means for retaining an interior film.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for an energy efficient, heat insulating window design. When describing the present invention, all terms not defined herein have their common art-recognized meanings.

Figure 1:
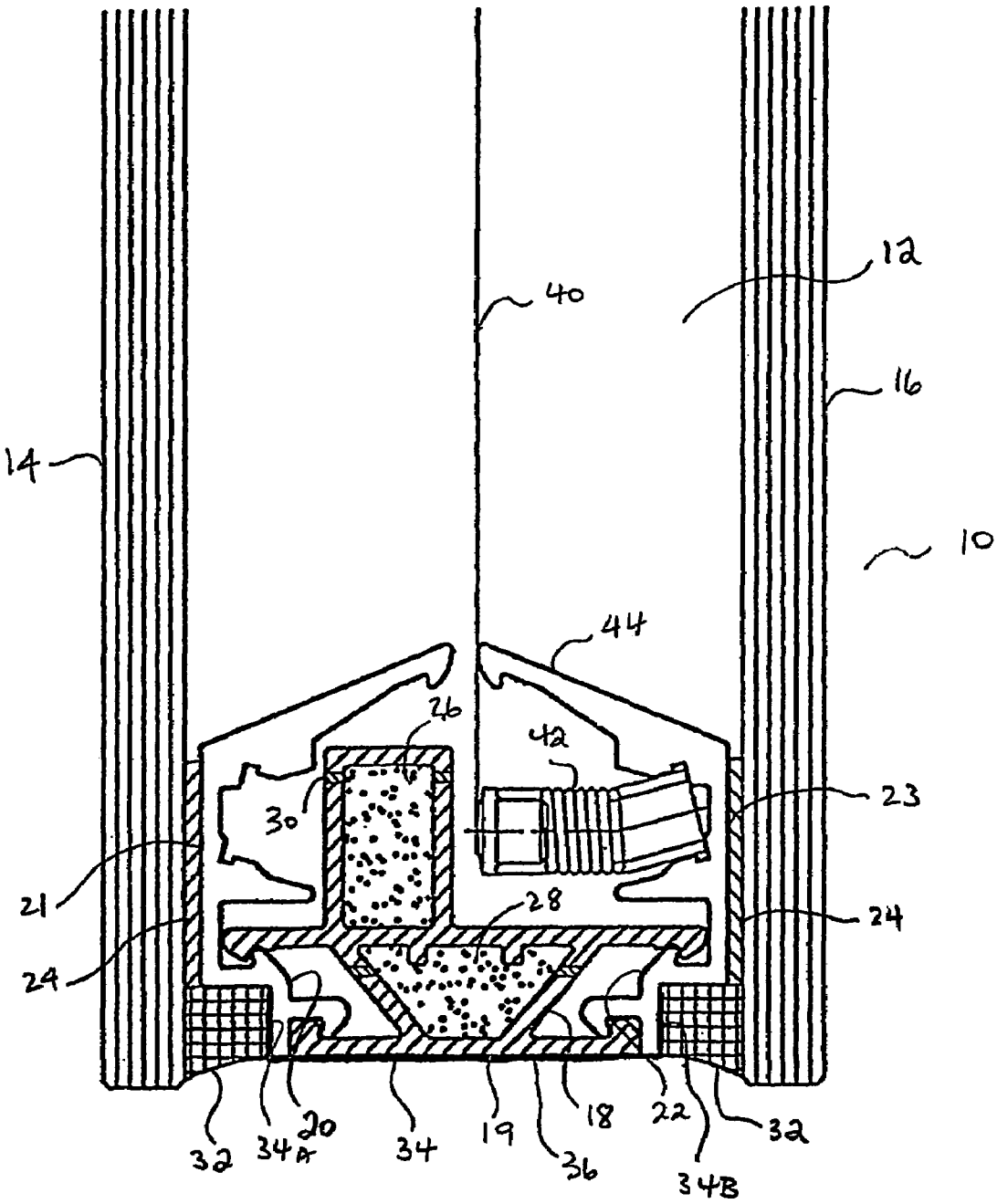
FIG. 1 is a cross-sectional view of edge spacer and sealing system of the present invention.

FIG. 1 shows a cross-sectional view of an edge spacer and sealing system of a window unit (10). Those skilled in the art will realize that the members shown in cross-section in FIG. 1 are provided continuously around the edge of the window unit (10) to completely seal the interior volume (12) from the exterior.

As shown in FIG. 1, dual glass panes (14, 16) are spaced apart by a spacer assembly which comprises a central spacer (18) and a first lateral member (20) and a second lateral member (22). The first lateral member (20) has a first outer surface (21) which abuts up against the glass pane (14). Similarly, the second lateral member (22) has a second outer surface (23) which abuts up against the other glass pane (16).

The first and second lateral members are attached to the glass panes by means of an adhesive (24) such as an acrylate adhesive or some other suitable adhesive as is well-known in the art. The lateral members (20, 22) may be preferably extruded from aluminum which is preferred for its light weight, rigidity and strength.

The central spacer (18) has a third outer surface (19) which is perpendicular to the plane of the glass panes (14, 16). In a preferred embodiment, the central spacer defines at least one and preferably two dessicant chambers (26, 28) which are filled with a dessicating material. Vents (30) permit the passage of air to and from the dessicant chambers into the interior air volume. The central spacer (18) interlocks with the two lateral members (20, 22) in order to maintain the two glass panes in a spaced and parallel relationship.

The central spacer (18) is preferably formed from a plastic material with a relatively low heat conductivity to minimize any thermal bridging effect between one glass pane to the other. In a preferred embodiment, the central spacer if extruded from a thermoplastic material such as polyvinylchloride or polyamide.

Each lateral member (20, 22) defines a sealing groove filled with a sealing material (32) immediately adjacent its junction with the central spacer. The sealing groove therefore runs along the glass pane, outside of the central spacer, as shown in the Figures. The sealing groove is filled with a vapour-proof gas tight seal (32) element. Preferably, the seal element comprises hot-melt butyl adhesive, which is well known for its vapour proof qualities. Other sealing materials which are suitably vapour-proof are well known in the art. The sealing groove (and therefore the seal 32) is shown as substantially square in cross-section, however, that is not an essential element of the invention.

A capping band (34) is provided to cover the third outer surface (19). However, rather than extending to the glass panes, the band (34) is bent at either edge (34A, 34B) to follow the contour of the sealing groove. The butyl seal (32) contacts the outer surface of the band (34). Therefore, the band (34) prevents the hot-melt butyl from creeping in between the third outer surface (19) of the central spacer (18) and the interior surface of the band. The band is preferably made from a strong, vapour-proof, oxidation-resistant and low heat-conductive material, such as a thin stainless steel foil.

Figure 2:
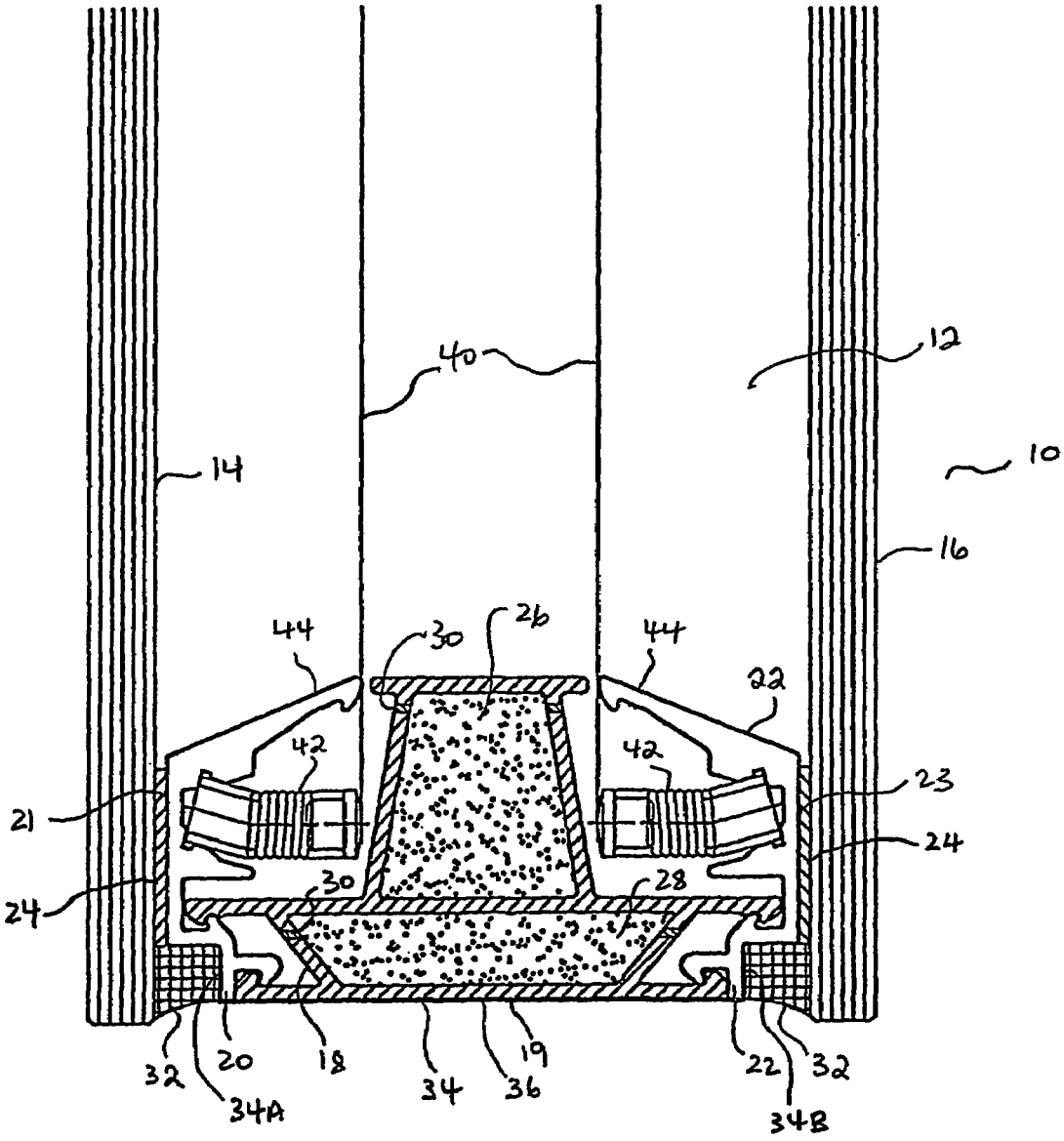
FIG. 2 is a cross-sectional view of an alternative embodiment of the present invention.

In both FIGS. 1 and 2, the window units shown include interior volume dividing films (40). Such films (40) enhance the insulating value of the window unit (10) however are not essential elements of the present invention. In the embodiment shown in FIG. 1, a single film (40) is shown, whereas in FIG. 2, a dual film (40) embodiment is shown. In each case, the film is suspended from a lateral member (20, 22) by means of a tensioning member (42) which is preferably a helical spring. A plurality of springs (42) are provided around the periphery of the window unit (10), thereby suspending the film (40) within the interior volume (21), substantially parallel to each glass pane. Each spring (42) is mounted in a channel formed in the lateral member. Each lateral member which includes means for suspending the film includes a lip (44) which projects outward and contacts the film (40), in order to seal the partitioned interior volume created by the film.

As shown in FIG. 1, the lateral members may be identical for ease of fabrication, even in an embodiment with a single interior film, where the lateral member (20) does not include means for suspending a film. In such an embodiment, however, the central portion (18) must have a slightly different profile to accommodate the asymmetric nature of the single film embodiment, as is shown in FIG. 1.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A heat insulation window comprising:

(a) a pair of outer panes defining an air space therebetween;

(b) a spacing member disposed between the outer panes which maintain the panes in a spaced-apart relationship, the spacing member comprises a central spacer and opposing lateral members, wherein the central spacer engages and separates the opposing lateral members and at least one lateral member comprises an attachment for retaining an interior film, and wherein the spacing member further comprises an outer surface extending between the first and second lateral members;

(c) wherein a first lateral member defines a first sealing groove, and a second lateral member defines a second sealing groove;

(d) a first seal disposed within the first sealing groove, and a second seal disposed within the second sealing groove, wherein the first and second seals are separated by the central spacer;

(e) a metal band parallel to and overlaying the outer surface, wherein the band comprises edge flanges extending into the sealing grooves without direct contact with the pair of outer panes, isolating the first seal and second seal from the interface between the metal band and the central spacer.

2. The window of claim 1 wherein the first and second sealing grooves has a substantially square cross-section.

3. The window of claim 2 wherein the central spacer is discrete from and interlocks with each of the two lateral members.

4. The window of claim 1 wherein the seal element comprises a butyl adhesive.

5. The window of claim 1 wherein the metal band comprises a stainless steel foil.

* * * * *